US010502225B2

(12) United States Patent
Knopp et al.

(10) Patent No.: US 10,502,225 B2
(45) Date of Patent: Dec. 10, 2019

(54) CENTRIFUGAL FAN ASSEMBLY FOR ROAD SWEEPING MACHINES

(71) Applicant: Johnston Sweepers Limited, Dorking, Surrey (GB)

(72) Inventors: Gareth Knopp, Gillingham (GB); Michael Sandford, Redhill (GB); Stephen Catchpole, Sheerness (GB)

(73) Assignee: Johnston Sweepers Limited, Dorking, Surrey (GB)

( * ) Notice: Subject to any disclaimer, the term of this patent is extended or adjusted under 35 U.S.C. 154(b) by 751 days.

(21) Appl. No.: 15/125,033

(22) PCT Filed: Mar. 18, 2015

(86) PCT No.: PCT/GB2015/050789
§ 371 (c)(1),
(2) Date: Sep. 9, 2016

(87) PCT Pub. No.: WO2015/140546
PCT Pub. Date: Sep. 24, 2015

(65) Prior Publication Data

US 2017/0016453 A1 Jan. 19, 2017

(30) Foreign Application Priority Data

Mar. 20, 2014 (GB) ..... 1405023.1

(51) Int. Cl.
*F04D 29/28* (2006.01)
*E01H 1/08* (2006.01)
(Continued)

(52) U.S. Cl.
CPC ..... *F04D 29/281* (2013.01); *E01H 1/0809* (2013.01); *E01H 1/0818* (2013.01); *F04D 29/4226* (2013.01); *F04D 29/666* (2013.01)

(58) Field of Classification Search
CPC ..... F04D 29/281; F04D 29/28; F04D 29/266; F04D 29/263
(Continued)

(56) References Cited

U.S. PATENT DOCUMENTS 4,232,994 A 11/1980 Tsuji
4,779,303 A * 10/1988 Duthie ..... E01H 1/0827 15/326
(Continued)

FOREIGN PATENT DOCUMENTS

CH 278711 A 10/1951
EP 0234782 A2 9/1987
(Continued)

*Primary Examiner* — Carlos A Rivera
*Assistant Examiner* — Jason Mikus
(74) *Attorney, Agent, or Firm* — Gable Gotwals

(57) ABSTRACT

The present invention is directed to a centrifugal fan assembly (19) for the debris collection arrangement (100) of a road cleaning machine (10). The assembly (19) comprises a casing (101), a rotatable impeller (103) and a wall (107). The casing (101) comprises a volute portion (30) connected to an outlet passageway (31), a corner (106) being formed therebetween. The impeller (103) comprises a plurality of blades (25) and is located in the volute portion (30) proximate the corner (106). The wall (107) separates the outlet passageway (31) into a first and second passageway (36, 37) and extends to an inner end (102) proximate the impeller (103). The inner end (102) is positioned, and the impeller (103) is arranged, such that when a blade (25) passes the inner end (102) a second pressure wave is formed that destructively interferes with a first pressure wave formed by a blade (25) passing the corner (106). The distance W between the inner end (102) and impeller (103) is greater than the distance Z between the corner (106) and impeller (103).

16 Claims, 8 Drawing Sheets

(51) Int. Cl.
*F04D 29/42* (2006.01)
*F04D 29/66* (2006.01)

(58) Field of Classification Search
USPC ..... 415/121.1
See application file for complete search history.

(56) References Cited

U.S. PATENT DOCUMENTS

| | | | | |
|---|---|---|---|---|
| 5,536,140 | A | 7/1996 | Wagner et al. | |
| 5,601,400 | A | 2/1997 | Kondo et al. | |
| 2002/0108211 | A1 | 8/2002 | Svoboda | |
| 2002/0159881 | A1 | 10/2002 | Marshall et al. | |
| 2008/0279681 | A1* | 11/2008 | Eguchi ..... | F04D 29/162<br>415/206 |
| 2011/0250065 | A1 | 10/2011 | Liang et al. | |

FOREIGN PATENT DOCUMENTS

| | | | |
|---|---|---|---|
| EP | 2146097 | A1 | 1/2010 |
| EP | 2182220 | A1 | 5/2010 |
| FR | 1038819 | A | 10/1953 |
| GB | 2046360 | A | 11/1980 |
| GB | 2225814 | A | 6/1990 |
| JP | 57206799 | A | 12/1982 |
| JP | 59192899 | A | 11/1984 |
| JP | 2000073996 | A | 3/2000 |
| JP | 2006283689 | A | 10/2006 |
| JP | 2008261274 | A | 10/2008 |
| KR | 20030045481 | A | 6/2003 |

* cited by examiner

CENTRIFUGAL FAN ASSEMBLY FOR ROAD SWEEPING MACHINES

CROSS-REFERENCE TO RELATED APPLICATIONS

This United States application is the National Phase of PCT Application No. PCT/GB2015/050789 filed 18 Mar. 2015, which claims priority to British Patent Application No. 1405023.1 filed 20 Mar. 2014, each of which is incorporated herein by reference.

This invention relates to centrifugal fan assemblies for road cleaning machines.

Road cleaning machines (also known as sweepers) are commonly used to remove unwanted debris from streets. A typical road cleaning machine 10 is shown in FIG. 1, which in this instance is a four-wheeled compact sweeper 10 in the form of a driver operated vehicle having a front axle and corresponding wheels 11 and a rear axle and corresponding wheels 12. An operator control station 13 is located towards the front of the vehicle, under which there are provided cleaning tools, such as cleaning brushes 14 and debris collection arrangement 15.

The debris collection arrangement 15 commonly comprises suction conduits providing a passageway for picking up debris from the road and delivering it to a container mounted on the vehicle chassis. The suction force in the conduits is commonly provided by a centrifugal exhauster fan that is arranged to create a negative pressure in the container. The conveyancing force draws the debris from the suction conduits into the container and once in the container, the debris is separated from the air by means of a separation system before being exhausted by the fan to the atmosphere.

A suitable centrifugal fan is disclosed in GB-A-2225814. The centrifugal fan comprises an impeller having circular front and back plates and a plurality of blades therebetween. The blades are each joined at one end to a generally cylindrical hub. Means are provided, commonly in the form of a motor, for rotating the hub and thereby the impeller. The impeller is housed in a casing having a volute portion and an air outlet. The sides of each blade are welded to the back plate and front plate of the impeller. The front plate comprises an air inlet to allow air to enter the impeller.

However, as the impeller rotates the sound power generated, i.e. the acoustical energy emitted from a sound source, by the fan can be significant. The high sound power causes discomfort to both operators and pedestrians when the fan is in use. An object of this invention is, therefore, to reduce the sound power generated by a centrifugal fan for the debris collection arrangement of road sweeping machines, but to avoid a reduction in the suction force provided by the centrifugal fan.

The invention therefore provides a centrifugal fan assembly for the debris collection arrangement of a road cleaning machine, the assembly comprising: a casing comprising a volute portion connected to an outlet passageway and an air inlet, a corner being formed in the casing between the volute portion and the outlet passageway; a rotatable impeller comprising a plurality of blades, the impeller being located in the volute portion proximate the corner and arranged to draw in air from the air inlet and direct the air to the outlet passageway; and a wall separating the outlet passageway into a first and second passageway, the wall extending to an inner end proximate the impeller, wherein the inner end is positioned, and the impeller is arranged, such that when a blade passes the inner end a second pressure wave is formed that destructively interferes with a first pressure wave formed by a blade passing the corner.

Preferably the distance W between the inner end and impeller is greater than the distance Z between the corner and impeller.

Preferably W is in the range of from 1.1Z to and including 1.5Z.

In preferred embodiments the angle about the centre of rotation of the impeller between the inner end and corner, also known as the offset angle, is substantially less than 180°, more preferably less than 160° and yet more preferably less than 145°. In a particular preferred embodiment the angle about the centre of rotation of the impeller between the inner end and corner is 132.5°.

Preferably the angle about the centre of rotation of the impeller between the inner end and corner is the sum of: the angle between at least two of the plurality of blades; and an angle, which is less than the angle between two adjacent blades, resulting in the second pressure wave being out of phase by approximately 180° to the first pressure wave. In particular, the angle about the centre of rotation of the impeller between the inner end and corner is the sum of: the angle between three of the plurality of blades; and an angle, which is less than the angle between two adjacent blades, resulting in the second pressure wave being out of phase by approximately 180° to the first pressure wave.

In some embodiments the number of blades is a multiple of three. The blades may be substantially evenly spaced, or asymmetrically spaced. In these embodiments the offset angle is in the range of 105° to 135°.

Preferably the throat size of the outlet passageway increases towards the exit of the outlet passageway. Further preferably the wall is positioned such that a substantially similar amount of air is directed through each of the first and second passageways when the impeller is rotating. Yet further preferably the inner end is positioned midway between the outer periphery of the impeller and casing in the volute portion.

Preferably the exit of the outlet passageway is connected to a rear outlet arrangement, the rear outlet arrangement comprising an internal rear duct enclosed by a cover leading to an air exit from the centrifugal fan assembly.

Preferably the internal rear duct is split into first and second passageways by a wall.

Preferably the throat size of the internal rear duct increases towards the air exit.

The invention further provides an impeller for a centrifugal fan assembly of the debris collection arrangement of a road cleaning machine, the impeller comprising: first and second plates mounted around a hub; a plurality of blades mounted between the first and second plates and spaced around the hub, each blade having a first adjacent blade located on one side thereof and a second adjacent blade located on an opposing side thereof, the spacing between each blade and the first adjacent blade being different to the spacing between each blade and the second adjacent blade.

Preferably the plurality of blades are formed of one or more set(s) of a leading blade, a primary blade and a lagging blade, wherein: the leading blade is separated from the primary blade by a first angle; the lagging blade being separated from the leading blade by a second angle; the primary blade being separated from an adjacent leading blade by a third angle; and the third blade angle is greater than the first blade angle and the second blade angle is greater than the third blade angle.

Preferably the first blade angle is X°, the second blade angle is X°+2Y° and the third blade angle is X°+Y°.

Preferably the blades are rearwardly curved.

The invention further provides the aforementioned centrifugal fan assembly comprising the aforementioned impeller.

Preferably the offset angle between the inner end and corner is calculated using the equation:

$$\text{Offset Angle} = N_{set} \times \left(\frac{2\pi}{n}\right) + \frac{(N_{set} \times Y)}{p} + Y$$

in which $N_{set}$ is the number of sets of blades, n is the total number of blades, p is the number of restrictions and Y is the difference between the first and third angles.

The invention further provides a debris collection arrangement comprising the aforementioned centrifugal fan assembly and/or impeller. The invention further provides a road cleaning vehicle comprising the aforementioned centrifugal fan assembly and/or impeller.

By way of example only, embodiments of a centrifugal fan assembly for a road cleaning vehicle are now described with reference to, and as show in, the accompanying drawings, in which.

The present invention is generally directed towards centrifugal fan assemblies for road cleaning machines.

The sound power produced by a centrifugal fan (ignoring the sound power from other components such as the motor or bearings) comprises blade passing tones and a continuous spectrum of noise. Central to understanding the mechanics of the sound power is the blade pass frequency (BPF), which is the frequency (in Hz) at which the blades pass a single reference point and is calculated using the equation:

$$BPF = \frac{Nt}{60}$$

in which N is the rotational velocity of the hub in revolutions per minute and t is the number of blades.

The continuous spectrum of noise is partially a result of eddies in the air behind the trailing edge of each blade and outward pulses of air pushed forward by the leading edge of the blades. The eddies produce a broad spectrum of random noise and the outward pulses occur at the BPF with its harmonics. Both are stronger near the tips of the blades, being that fastest moving parts of the blades. The continuous spectrum of noise is also formed by resonance and reverberation of the rapidly moving air through the inlet and outlet ducts connected to the centrifugal fan.

The blade passing tones are created when each blade passes the wall of the outlet duct at which the spacing between the blade and the casing is discretely restricted. At this point the air between the blade and casing is rapidly compressed and a pressure or sound pulse, referred to herein as a blade passing tone, is produced. The blade passing tone comprises waves at the BPF and its harmonics, the frequency $F_n$ of harmonic n being calculated using the equation:

$$F_n = \frac{Ntn}{60}$$

The blade passing tones are amplified particularly where the BPF or its harmonics match the resonant frequency of the casing, hub or other component of the centrifugal fan.

The motion of the blade tips can be modelled as a sine wave. The position y at time t can be characterised by the equation:

$$y(t)=A\ \sin(\omega t+\varnothing)$$

in which A is radius of the impeller from the centre of rotation to the blade tip, ω is the angular frequency and ø is the phase angle (the offset angle of the blades as described below).

Figure 1:
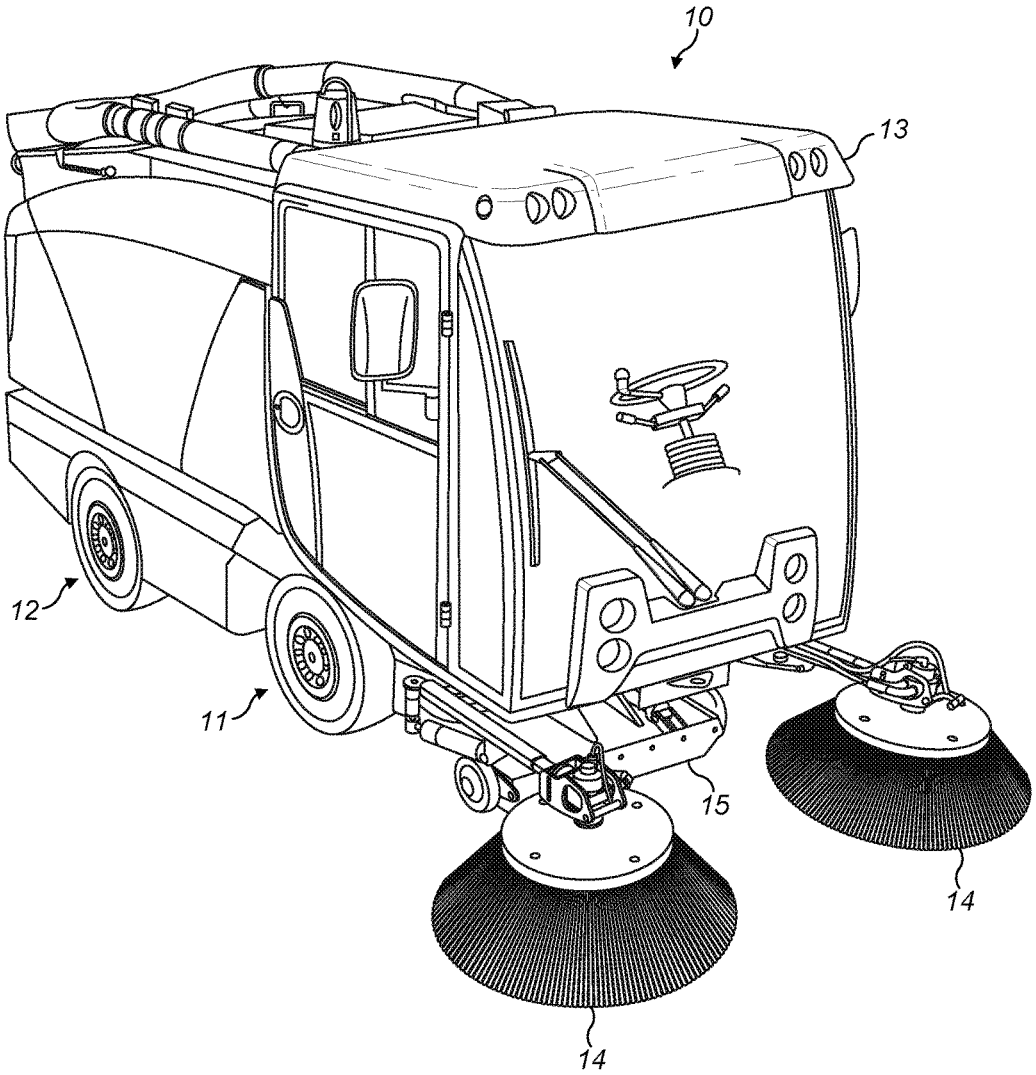
FIG. 1 is a perspective view of a typical road cleaning machine of the prior art.
Figure 2:
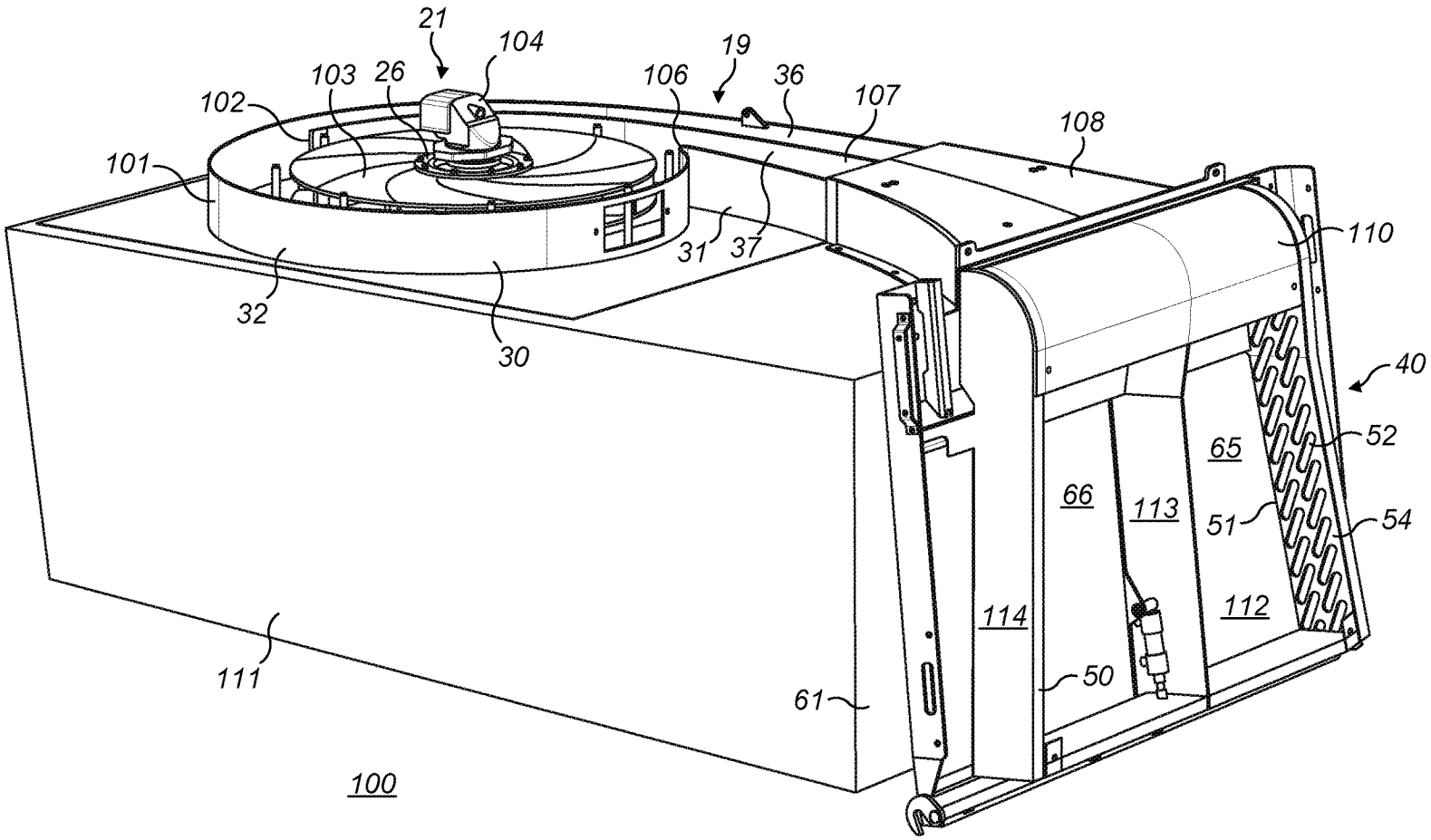
FIG. 2 is a perspective view of a debris collection arrangement comprising the centrifugal fan assembly of the present invention.

The present invention is directed to reducing the sound power produced by the centrifugal fan of a road sweeping machine in the view of the continuous spectrum of noise and the blade passing tones. FIG. 2 illustrates an embodiment of a debris collection arrangement 100 comprising a centrifugal fan assembly 19 of the present invention.

The debris collection arrangement 100 comprises an inlet conduit 20 providing a passageway for directing collected debris into a container 111. The shape of the container 111 is a substantially rectangular cuboid, although in other embodiments it may be any other suitable shape. The inlet conduit 20 (see FIG. 4) is connected to a first end 60 of the container 111. A nozzle or the like (not shown) is connected to the end of the inlet conduit 20 for collecting the debris from, for example, the road or pavement. The container 111 collects and stores the debris for later removal by an operator.

The centrifugal fan assembly 19 is mounted to the container 111 and comprises a centrifugal fan 21, an outlet duct 108 and a rear outlet arrangement 40. The centrifugal fan 21 and outlet duct 108 are mounted on the top side of the container 111 and the outlet arrangement 40 is mounted on, or adjacent to, a second end of the container 111. However, in other embodiments the centrifugal fan assembly 19 may be mounted on the container 111 in any other suitable way.

Figure 3:
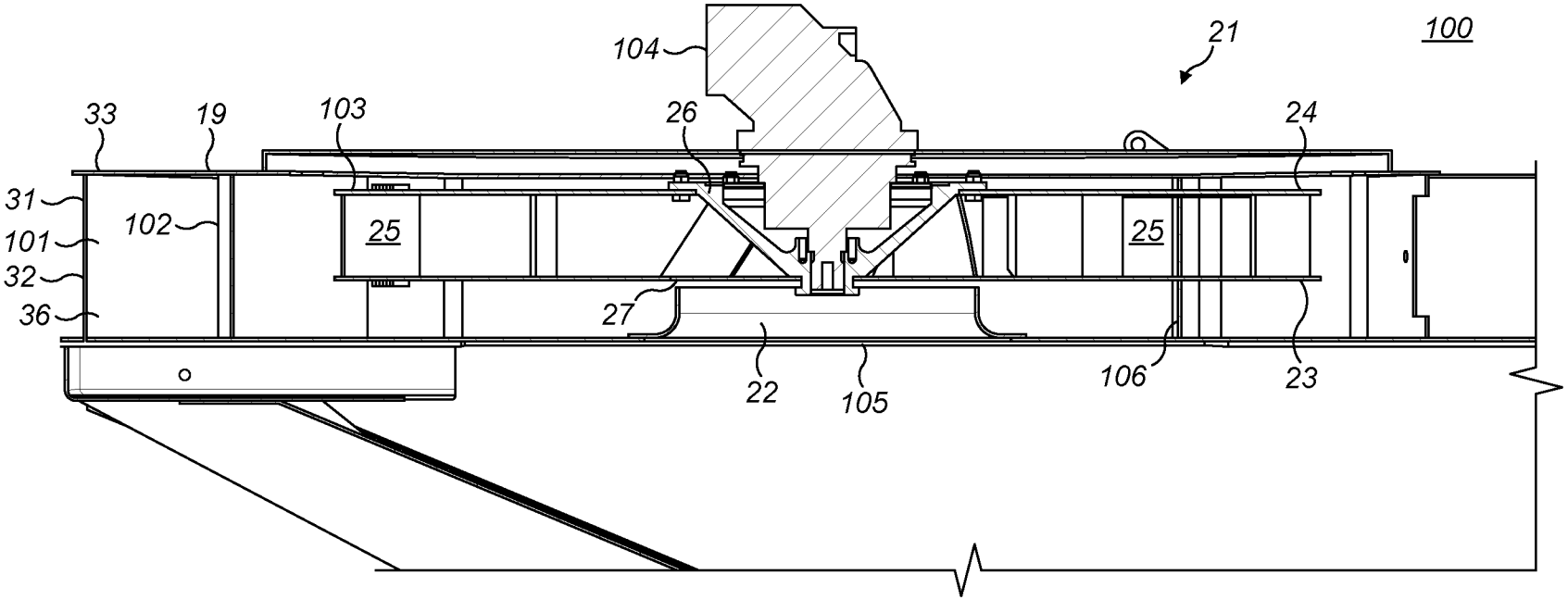
FIG. 3 is a partly sectioned side elevation of the debris collection arrangement of FIG. 2.
Figure 4:
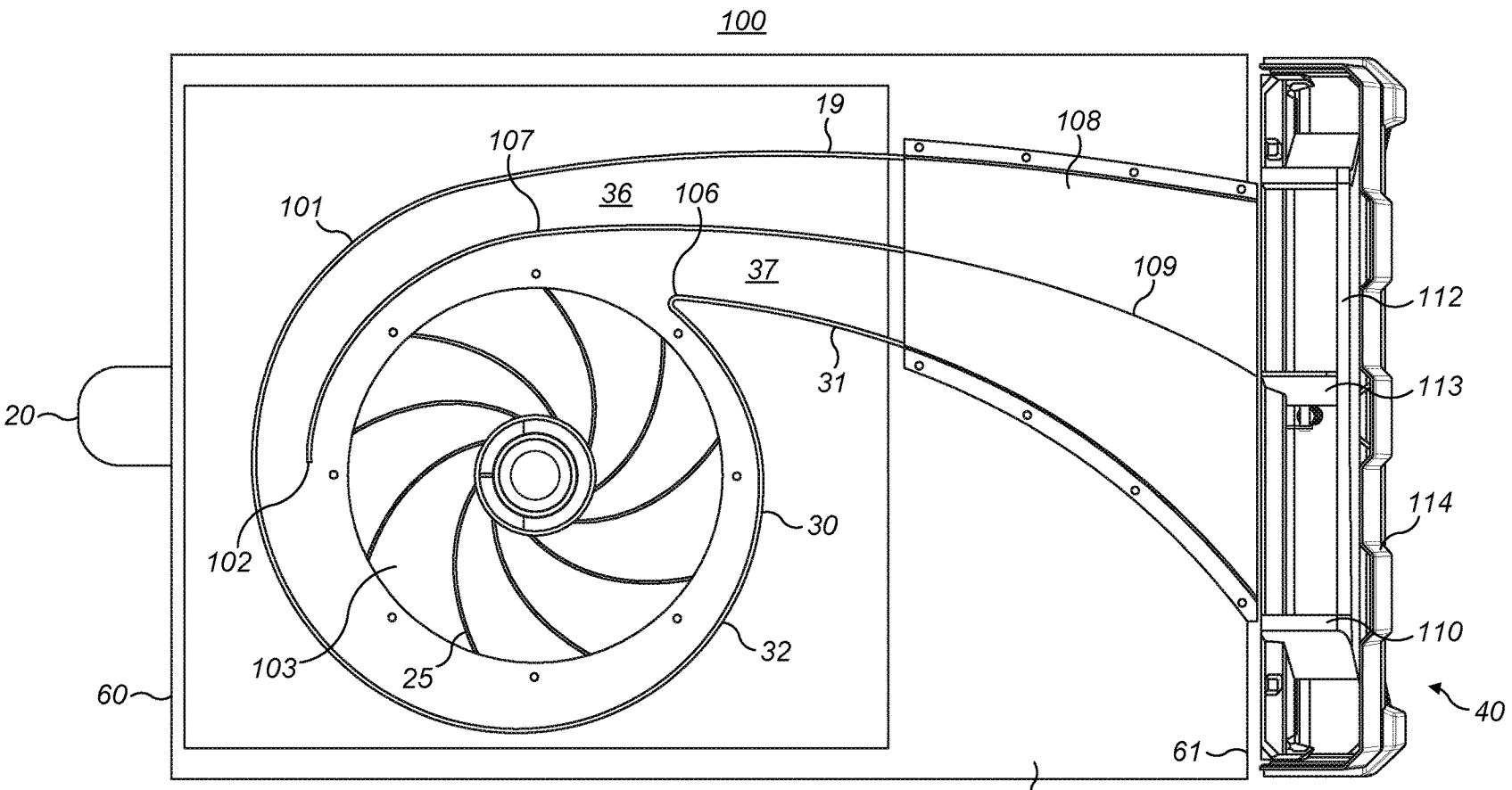
FIG. 4 is a plan view of the debris collection arrangement of FIGS. 2 and 3 with the top side of the centrifugal fan assembly hidden.

The centrifugal fan 21 is mounted over a container outlet 22 and is arranged to create a vacuum in the container 111 by drawing in air in the container. As illustrated in FIGS. 2 to 4, the fan 21 comprises a casing 101 and an impeller 103. The impeller 103 comprises substantially circular first and second plates 23, 24 (see FIG. 3). The first plate 23 comprises an air inlet in the form of a central hole 27 which is mounted over the container outlet 22. The container outlet 22 is in the form of a bell mouth extending upwards towards the central hole 27. The bell mouth assists in providing a continuous and smooth flow of air into the impeller 103, thereby reducing the sound power of the fan 21.

A plurality of blades, generally designated as 25 herein, are attached between the first and second plates 23, 24, for example by welding or the like. At the inner ends of the blades 25 a substantially conical hub 26 is provided. The smaller end of the hub 26 is located adjacent to the container outlet 22 and the larger end of the hub 26 is located furthest from the container outlet 22.

A motor 104 is operably connected to the hub 26. A control unit and a power supply (not shown) are operable to selectively actuate the motor 104 and thereby rotate the impeller 103. During rotation the pressure variations created by the blades 25 direct air from the container 111 through the container outlet 22, into the impeller 103 and subsequently into the internal volume of the casing 101.

Figure 5:
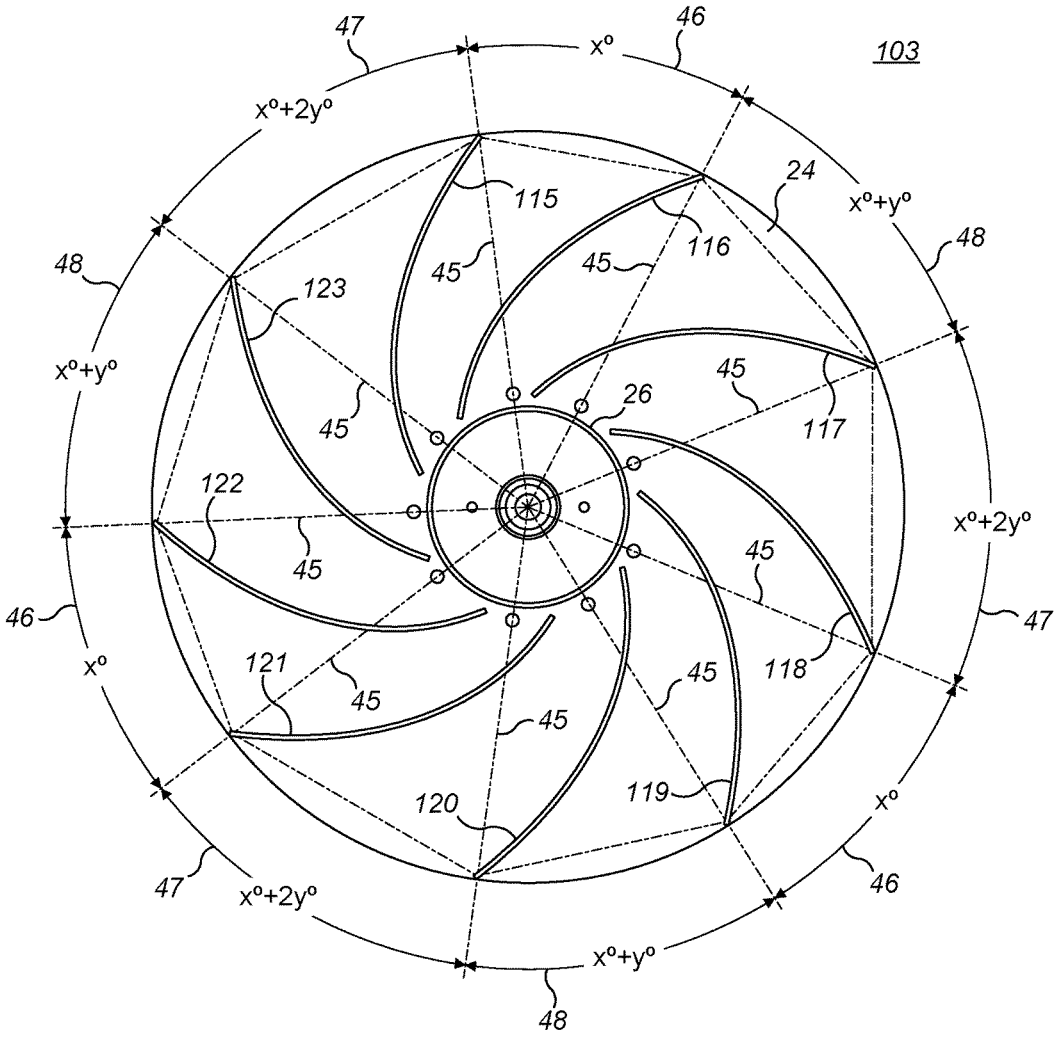
FIG. 5 is a plan view of the underside of an impeller of the debris collection arrangement of FIGS. 2 to 4 with a first plate hidden.

The arrangement of the blades 25 is shown in further detail in FIG. 5, which illustrates the impeller 103 from the side of the first plate 23 with the first plate 23 removed. Each blade 25 is preferably rearwardly or backwardly curved such that it curves away from the direction of rotation. Preferably each blade 25 has a blade vector angle of nominally 45°. The benefit of a rearward curved blade 25 is that as the impeller rotates there is no slowing down and speeding up of the air as it spills off the blade at a constant relative direction vector. In other embodiments each blade 25 is straight or forward curved. Each blade may have any suitable cross-sectional shape and thickness.

There may be any suitable number of blades. Preferably the number of blades 25 is a multiple of three, i.e. three, six, nine, twelve, fifteen and so on. In the illustrated embodiment nine blades 25 are provided and are individually designated 115, 116, 117, 118, 119, 120, 121, 122 and 123 herein.

The blades 25 are arranged in an asymmetric pattern such that they are not evenly spaced from one another, i.e. the blade angle 46, 47, 48 varies. The blade axis 45 is defined herein as a radial line extending from the centre of rotation of the impeller 103, perpendicular to the axis of rotation, to the tip of the blade 25. Where the tip of the blade 25 is of a substantial thickness, the axis 45 extends to the rearmost point of the blade 25. The blade angle 46, 47, 48 is defined as the angle between two adjacent blades 25.

Thus the impeller 103 illustrated can be described as a backwards curved centrifugal impeller with axially asymmetric blade spacing.

Each set of three blades 25 has a primary blade 116, 119, 122. A leading blade 115, 118, 121 is located in front of the primary blade 116, 119, 122 by a first blade angle 46, such as X°. A lagging blade 117, 120, 123 is located in front of the leading blade 115, 118, 121 by a larger second blade angle 47, such as X°+2Y°. The lagging blade 117, 120, 123 is located behind another primary blade 116, 119, 122 by a third blade angle 48 having a magnitude between the first and second blade angles 46, 47, such as X°+Y°. Thus each primary blade 116, 119, 122 is located in front of a lagging blade 117, 120, 123 by the third blade angle 48.

The use of the expression "in front of" herein is intended to indicate that, during rotation, a leading blade 115, 118, 121 passes a specific point before a primary blade 116, 119, 122 and a lagging blade 117, 120, 123 passes a specific point after a primary blade 116, 119, 122. Viewed from a specific point during rotation of the impeller 103 a leading blade 115, 118, 121 would be seen first, then a primary blade 116, 119, 122, then a lagging blade 117, 120, 123, then another leading blade 115, 118, 121 and so forth. In a particular embodiment there are nine blades 25 and the first blade angle 46 is 35°, the second blade angle 47 is 45° and the third blade angle 48 is 40°.

Thus the third blade angle 48 is preferably greater than the first blade angle 46 by a certain amount and the second blade angle 47 is greater than the third blade angle 48 by the same amount. Such an arrangement has been found to be suitable for effectively balancing the impeller 103.

In impellers with equally spaced apart blades 25 there will be a single BPF and the pressure waves generated by the movement of the blade 25, in particular those created as each blade 25 passes the restriction created at the corner 106 of the fan casing 101, will have a single frequency related to the BPF. The sounds waves produced by sequential blades will thus be substantially in phase with one another and will be superimposed at that frequency. Thus the sound power is relatively high. The sound power is particularly high where the BPF matches the resonant frequency of the casing 101.

Figure 6:
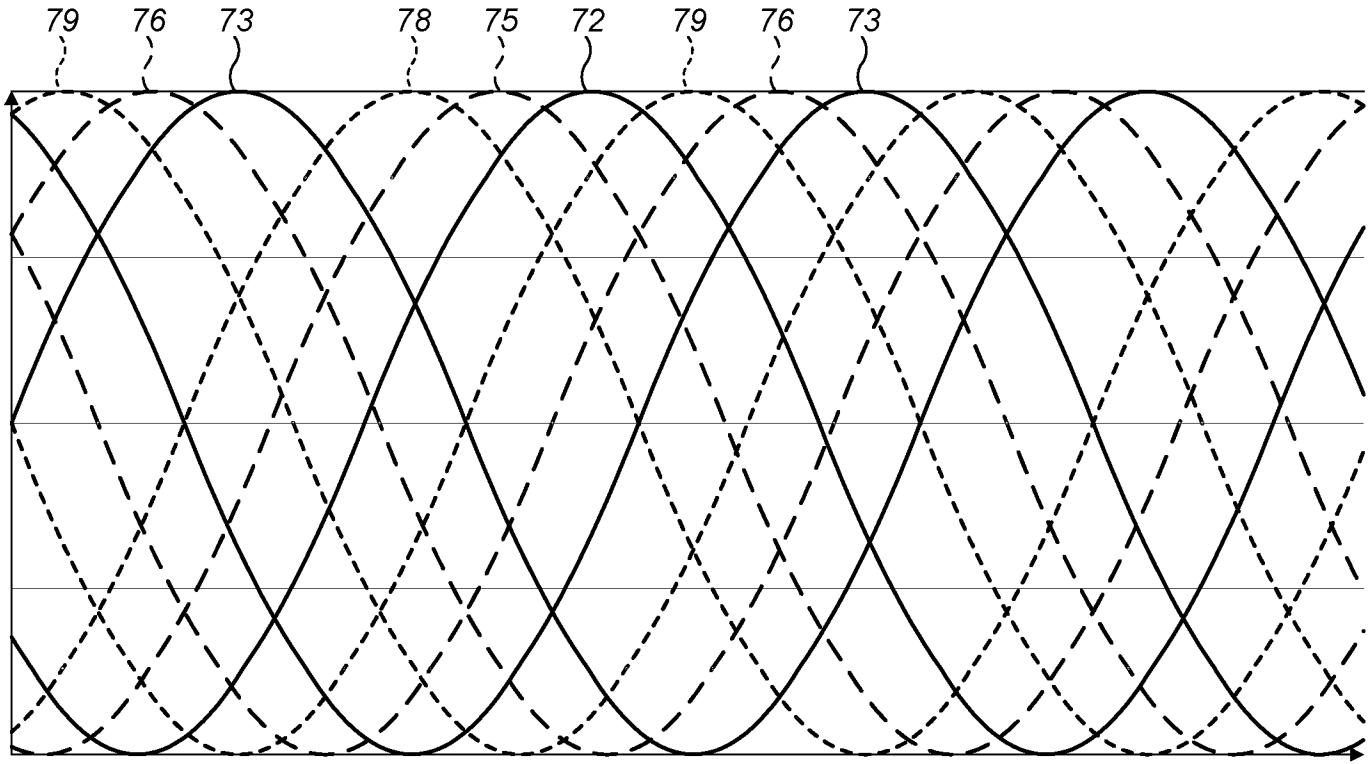
FIG. 6 is a graph illustrating the movement of a number of blades forming part of the impeller of FIG. 5.

The effect of the asymmetric arrangement of the blade 25 is illustrated in FIG. 6. FIG. 6 is a graph in which the Y-axis is the position of the tip of a blade 25 and the X-axis is time. The lines 71, 72, 73, 74, 75, 76, 77, 78, 79 illustrate the path of a blade tip, which follow a sinusoidal path as previously discussed herein. First, second and third leading lines 71, 74, 77 illustrate the path of a tip of a leading blade 115, 118, 121. First, second and third primary lines 72, 75, 78 illustrate the path of a tip of a primary blade 116, 119, 122. First, second and third lagging lines 73, 76, 79 illustrate the path of a lagging blade 117, 120, 123. As illustrated, the paths of the tips of the blades 25 in each set of blades 25 (i.e. a leading, lagging and primary blade) are out of phase from one another.

As a result of the asymmetric arrangement, the BPF and its harmonics for the impeller are no longer single values. From a reference point adjacent the impeller, the time taken between each blade passing by will vary. As a result, the pressure waves generated by the movement of one blade 25 will be out of phase to a pressure wave created by an adjacent blade 25. Thus amplitudes of the pressure waves created by the asymmetric impeller cannot be superimposed at their maxima and will be dispersed over a number of different frequencies or a frequency band. The superposition of the pressure waves at a single frequency is reduced, thus reducing the maximum magnitude of the sound power. Therefore, the centrifugal fan is quieter.

The casing 101 comprises an outer wall 32 defining a volute portion 30 in which the impeller 103 is located and an outlet portion 31 for directing air expelled by the impeller 103 to the outlet duct 108. Although not shown in FIGS. 2 and 4, the casing further comprises a top cover 33 located over the top of the volute portion 30 and outlet portion 31. The top cover 33 forms a substantially sealed internal volume of the casing 101.

A corner 106 is provided in the outer wall 32 where the impeller 103 is closest to the outer wall 32. The corner 106 forms the junction between the volute portion 30 and the part of the outlet portion 31 closest to the impeller 103. The outer wall 32 is curved, the centre of curvature being the centre of rotation of the impeller 103. The radius of curvature of the outer wall 32 increases continuously at a regular rate between the radius at the corner 106 to the radius at the start of the outlet portion 31. The volute portion 30 and impeller 103 are arranged such that the spacing therebetween increases from the corner 106, around the outer wall 32 and to the entry into the outlet portion 31.

The outlet portion 31 may be defined as the portion of the casing 101 between the outlet duct 108 and a plane passing through the corner 106 and the point in the outer wall 32 at which the radius of curvature stops steadily increasing (i.e. where a substantially perfect spiral ends). The throat size of the outlet portion 31, being the cross-sectional area of a plane extending across the outlet portion 31 between opposing parts of the outer wall 32, increases towards the exit of the outlet portion 31. The throat cross-section is substantially rectangular in shape. The height of the outlet portion, i.e. the dimension of the throat parallel to the axis of rotation of the impeller 103, remains substantially the same. However, as illustrated in FIG. 4, the distance between the opposing parts of the outer wall 32, i.e. the throat width, increases towards the exit of the outlet portion 31. The throat width increases continuously at a steady rate as the opposing parts of the outer wall 32 curve away from each other.

The outlet duct 108 is mounted to the top of the container 111, its inlet being sealably connected to the exit of the outlet portion 31 of the casing 101. The outlet duct 108 is arranged to direct air from the centrifugal fan 21 to the outlet arrangement 40. As illustrated in the Figures, the outlet duct 108 comprises a sheet bent or formed into shape and riveted to the container 111. However, in other embodiments the outlet duct 108 is formed integrally with the outlet portion 31. Alternatively, the casing 101 does not comprise an outlet portion 31 and instead the outlet duct 108 is connected directly to the volute portion 30. As such, the various possible arrangements of the outlet portion 31 and outlet duct 108 can be described as forming an outlet passageway 31, 108 leading from the volute portion 30 to the outlet arrangement 40.

The outlet passageway 31, 108 is split into two separate first and second passageways 36, 37 by a partition or wall 107. Other than at their ends, the first and second passageways 36, 37 are sealed from one another. The wall 107 extends from the exit of the outlet passageway 31, 108 to an inner end 102 substantially adjacent to the impeller 103.

The wall 107 is positioned to both reduce the sound power produced and ensure that a substantially similar amount of air is directed through each of the first and second passageways 36, 37 when the impeller 103 is rotating.

The effects are, in part, achieved by carefully positioning the wall 107 based upon the sizing of the impeller 103, the expected volume flow rate, the shape and/or size of the casing 101 and the throat width of the outlet passageway 31, 108. However, the inventors have found that the sound power produced can be dramatically reduced by the positioning of the inner end 102 and the distance around the impeller 103 by which the wall 107 extends. In particular, the inner end 102 is positioned such that a pressure wave is created in its vicinity as each blade 25 passes it by.

As the impeller 103 rotates, first pressure waves or blade passing tones are created by the restriction between a blade 25 and the corner 106. In addition, second pressure waves or blade passing tones are created by the restriction occurring between a blade 25 and the inner end 102 of the wall 107. The frequencies of the first and second pressure waves will be substantially similar to, or related to, the frequencies of the movement of each blade 25 in each set of blades 25. As the frequencies are substantially similar, and the arrangement of the inner end 102 is such that the second pressure wave is out of phase to the first pressure wave by approximately 180°, the first and second waves will destructively interfere. Thus the sound power output by the centrifugal fan 21 will be largely reduced.

The inner end 102 is positioned to ensure that this destructive interference occurs. The angle between the inner end 102 and the corner 106, named the offset angle herein, can be determined as the angle between first and second imaginary lines, the first line being between the centre of rotation of the impeller 103 and the corner 106 and the second line being between the centre of rotation of the impeller 103 and the inner end 102. In the embodiment where there are nine blades, if the offset angle is 120° the first and second pressure waves will be in phase and will constructively interfere. Thus the offset angle needs to be different to 120° for destructive interference to occur.

As illustrated in FIG. 4, the effect of this is that when one blade 25 is at the closest point to the corner 106, no blade 25 is at the closest point to the inner end 102. At this moment in time the distance between the closest blade 25 and the inner end 102 is arranged such that the second pressure waves will be half a wavelength out of phase to the first pressure waves. In other words, the inner end 102 needs to be out of phase to the corner 106 relative to the positioning of the blades 25. Thus destructive interference can occur.

In particular, the offset angle is substantially less than 180°, more preferably less than 160° and yet more preferably less than 145°. An offset angle of 132.5° is particularly suitable for the blades 25 being in a substantially symmetrical arrangement. If the number of blades 25 is a multiple of three, the offset angle is preferably in the range of 105° to 135°.

Where the blades 25 are in an asymmetric arrangement in sets of three, the preferred offset angle has been found to be calculated using the equation:

$$\text{Offset angle}=3(X+2Y)-0.5Y$$

where X and Y are determined as previously described in respect of the asymmetric blades. Thus, in the aforementioned example where X=35° and Y=5°, the offset angle is 132.5°. This is the calculation for the offset angle contrary to the direction of rotation. The offset angle in the direction of rotation is 360 minus this value, i.e. 227.5°.

Where there are any number $N_{set}$ of sets of blades, the offset angle opposite to the direction of rotation in radians can be calculated using the equation:

$$\text{Offset Angle} = N_{set} \times \left(\frac{2\pi}{n}\right) + \frac{(N_{set} \times Y)}{p} + Y$$

in which n is the total number of blades and p is the number restrictions, i.e. inner end 102 and corner 106 form two restrictions. In the direction of rotation the offset angle is 2π minus the angle calculated via the equation above.

In addition, the inventors have found that, when the inner end 102 is too close to the impeller 103, there is a negative effect on the flow of air into the passageways 36, 37 via the creation of turbulence and other such effects. As a result, it is preferred that the distance between the impeller 103 and the inner end 102 be slightly larger than the distance between the impeller 103 and the corner 106.

Figure 7:
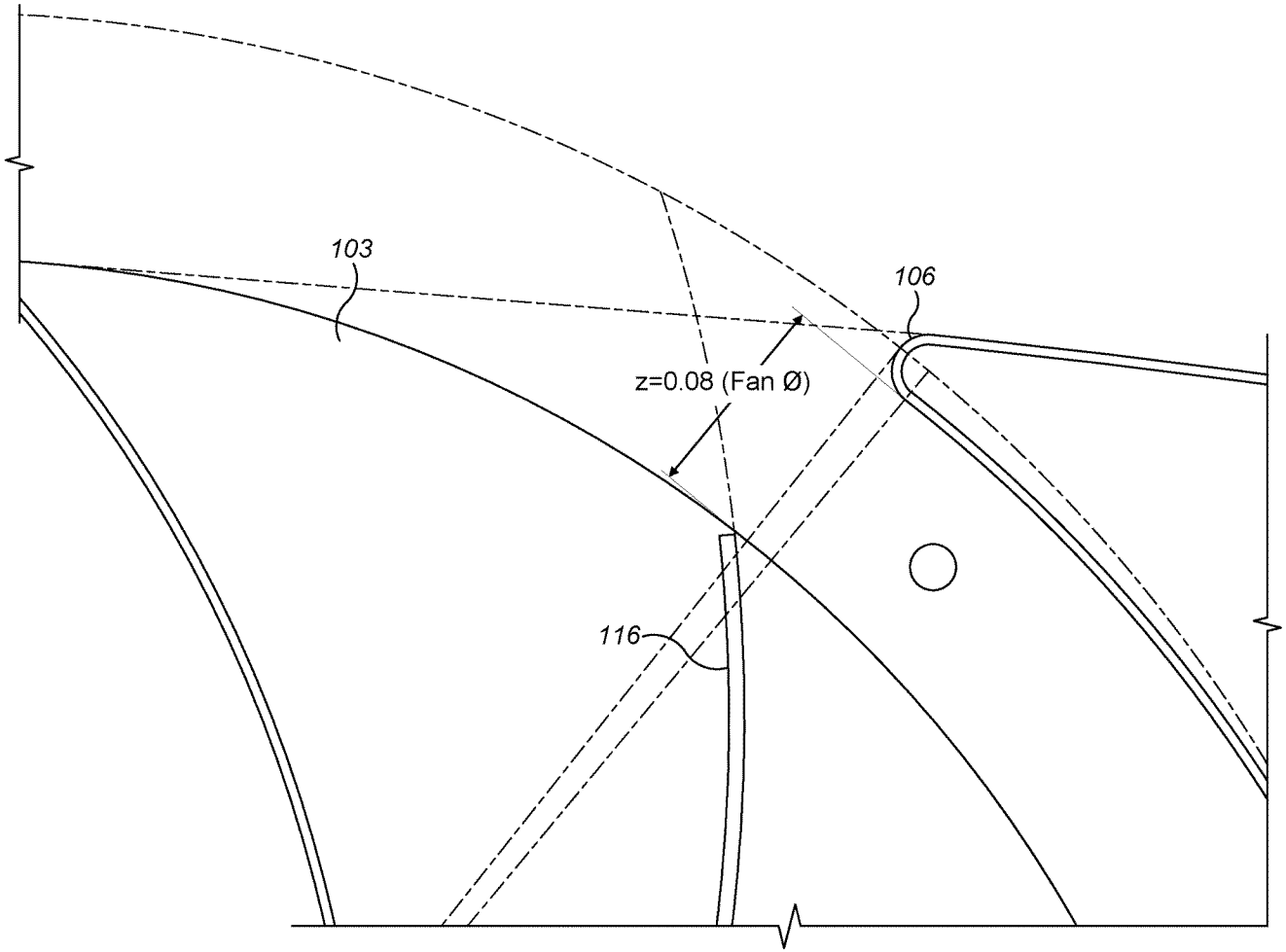
FIG. 7 is a plan view of a gap between a corner and blade of the debris collection arrangement of FIGS. 2 to 4.
Figure 8:
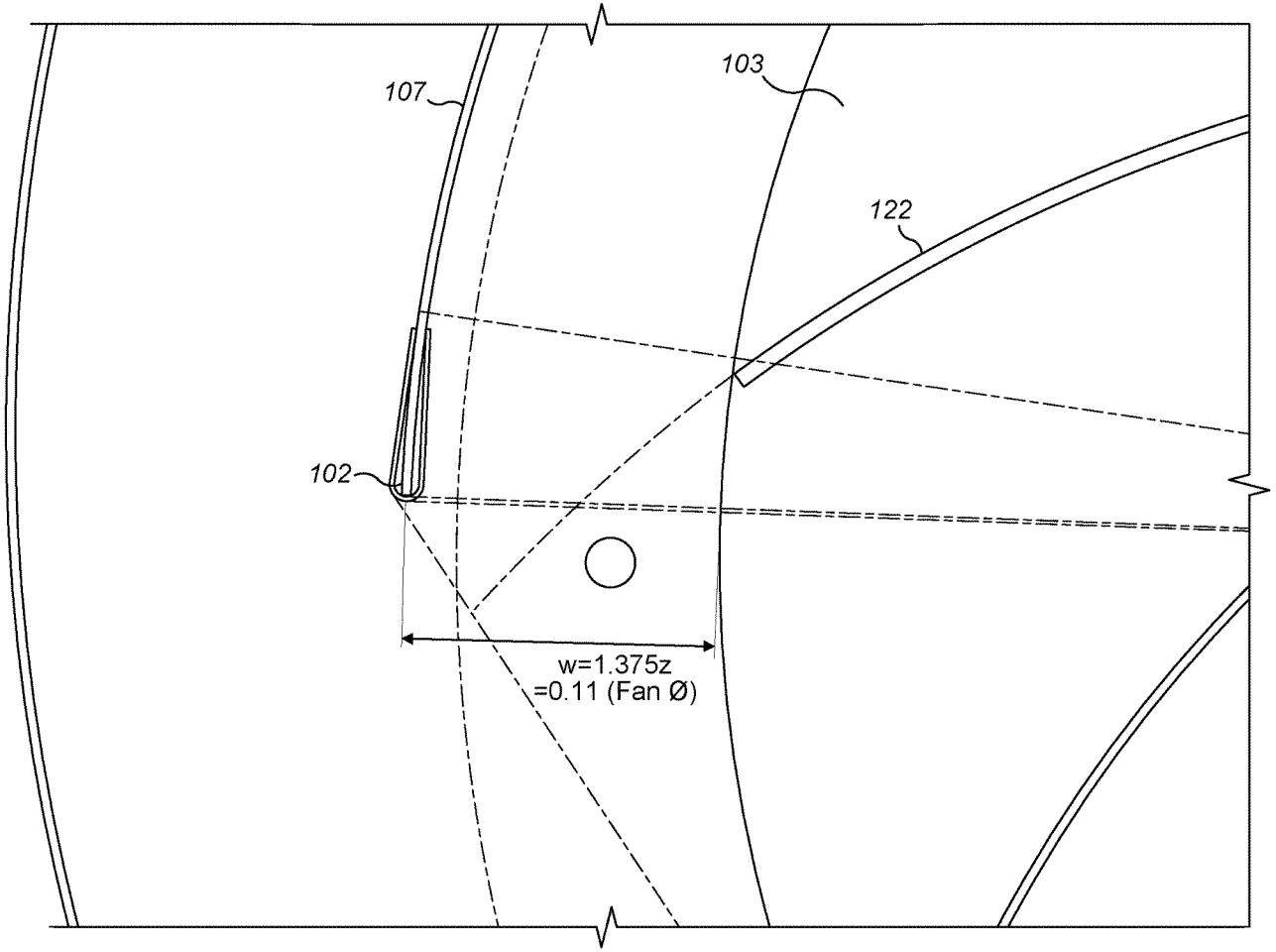
FIG. 8 is a plan view of a gap between an inner end of a wall and blade of the debris collection arrangement of FIGS. 2 to 4.

A suitable arrangement is illustrated in FIGS. 7 and 8. Preferably, the distance W between the impeller 103 and inner end 102 is in the range of from 1.1 to and including 1.5Z, where Z is the distance between the impeller 103 and the corner 106. Even more preferably W=1.375Z. The distances are calculated from the furthest points of the inner end 102 and corner 106 contrary to/into the direction of rotation of the impeller 103. Preferably W=0.11Q, where Q is the diameter of the impeller 103 and thus Z=0.08Q.

In general, the wall 107 is positioned midway between the walls of the casing 101 in the outlet portion 31, midway between the outer periphery of the impeller 103 and the casing 101 in the volute portion 30 and midway between the sides of the outlet duct 108. The splitting of the outlet passageway 31, 108 and outlet duct 112 into two separate passageways 36, 37, 65, 66 promotes laminar flow and reduces turbulence. In addition, the rate of increase in throat size causes these effects. Therefore, if there were no wall 107 the outlet passageway 31, 108 would need to be twice the length to achieve the same effect.

The rear outlet arrangement 40 extends down the second end of the container 111 and comprises an internal rear duct 112 enclosed by a rear cover 114. Although not always necessary, the rear outlet arrangement 40 assists in further sound attenuation and directs the air from the fan to a more suitably positioned exit than the exit of the outlet passageway 31, 108. In FIG. 2 the rear cover 114 is partially hidden to show the internal rear duct 112.

The rear duct 112 comprises an inlet at the exit of the outlet passageway 31, 108. A pair of opposing side walls 50, 51 extend downwards from the inlet and define the outer edges of the rear duct 112. Sound attenuating material layers 52 are provided on the side walls 50, 51 to reduce the sound power produced by the air flowing through the rear duct 112. The sound attenuating material is preferably an open cell foam or a matted fibre. Perforated plates 54 are provided over the top of the layers 52 to reduce damage to the sound attenuating material resulting from the impact of fast flowing air thereon.

The second end 61 of the container 111 may comprise a door or cover (not shown) attached to the body of the container 11 by a hinge. The door provides access to the debris drawn into the container 111. The hinge is operable to rotate the door upwards. As a result, the rear outlet arrangement 40 is attached to the door and/or container 111 such that it can rotate upwards about a pivot adjacent to the inlet to the arrangement 40.

In a similar manner to the outlet passageway 31, 108, the outlet duct 112 is split into two separate first and second passageways 65, 66 by a partition or wall 113.

The distance between the side walls 50, 51 increases gradually towards the exit of the rear outlet arrangement 40.

The walls 107, 113 may further comprise one or more layers, or be comprised of, a sound attenuating and/or anechoic material. The walls 107, 113 may therefore absorb the sound waves travelling down the outlet passageways 31, 108 and outlet duct 112 rather than allowing then to reflect or reverberate. As a result, the total sound power produced may be reduced.

In addition, the expansion of the throat area of the outlet passageway 31, 108 results in a continually expanding volume and thereby slows the air moved by the impeller 103 more evenly with less turbulence and eddy swirls. Therefore, the pressure waves and reverberations through the casing 101 are reduced and the sound power generated is reduced.

At the transition between the upper duct 108 and the vertical ducts 50 and 51, the Coanda effect is utilised to improve flow.

In the above-described embodiment the reduction in sound power is achieved by amongst others a combination of the wall 107, the expansion of the outlet passageway 31, 108 and outlet duct 112 and the asymmetric arrangement of the blades 25. However, in other arrangements the centrifugal fan may comprise either the wall 107, the expansion of the outlet passageway 31, 108 and/or outlet duct 112, or the asymmetric arrangement of the blades 25. The sound power reduction will not be as great as when all three are used, but in certain types of centrifugal fans all three may not be required as less sound power reduction is required.

However, the inventors have surprisingly found that a combination of at least the wall 107 and the asymmetric arrangement of the blades 25 can produce a greater total reduction in sound power than the reduction in sound power achieved individually by each of these components. It is thought that this is a result of the first and second pressure waves being produced with a broader range of frequencies/wavelengths. Destructive interference can occur over this broader range of frequencies/wavelengths, even where the first and second pressure waves are slightly out of phase. Thus the sound power is reduced dramatically.

Various benefits of the present invention will be apparent. The same volumetric flow rate can be achieved compared to the prior art centrifugal fans at the same pressure, such that performance is maintained. The frequency shift due to minimising the fan blade pass frequency spreads out peaks in noise, thereby lowering the overall sound power generation. A continual, but gradual, increase of the cross sectional area of the outlet passageway results in a reduction in turbulence and more gradual slowing of the air. Splitting the entire outlet chamber from the fan chamber to the atmospheric opening allows an even amount of air to be channelled between them. This improves efficiency by reducing system impedance throughout the outlet system. Finally, the clearly split channels in the exhaust provide a skilled person with an increased number of ways to tune the system to meet different operating requirements. The combination of the aforementioned effects reduces the sound power generation of the system, whilst maintaining cleaning and debris collection capabilities. This results in an overall efficiency increase in the system.

The invention claimed is:

1. A road cleaning vehicle comprising a debris collection arrangement, the debris collection arrangement comprising a centrifugal fan assembly, the centrifugal fan assembly comprising:

a casing comprising a volute portion, an outlet passageway and an air inlet, the volute portion being connected to the outlet passageway and the air inlet, a corner being formed in the casing between the volute portion and the outlet passageway;

a rotatable impeller comprising a plurality of blades, the impeller being located in the volute portion proximate the corner and arranged to draw in air from the air inlet and direct the air to the outlet passageway; and a wall separating the outlet passageway into a first and second passageway, the wall extending to an inner end proximate the impeller, the first and second passageways being sealed from one another other than at the ends of the first and second passageways, wherein the inner end is positioned, and the impeller is arranged, such that when a blade passes the inner end a second pressure wave is formed that destructively interferes with a first pressure wave formed by a blade passing the corner; and wherein the distance W between the inner end and impeller is greater than the distance Z between the corner and impeller, wherein a first angle about a center of rotation of the impeller between the inner end and corner is the sum of: a second angle between at least two of the plurality of blades; and a third angle, which is less than the second angle between at least two of the plurality of blades, resulting in the second pressure wave being out of phase by approximately 180° to the first pressure wave.

2. A road cleaning vehicle as claimed in claim 1 wherein W is in the range of from 1.1Z to and including 1.5Z.

3. A road cleaning vehicle as claimed in claim 1 wherein the first angle about the center of rotation of the impeller between the inner end and corner is the sum of:

a fourth angle between three of the plurality of blades; and a fifth angle, which is less than the second angle between at least two of the plurality of blades, resulting in the second pressure wave being out of phase by approximately 180° to the first pressure wave.

4. A road cleaning vehicle as claimed in claim 1 wherein a number of the plurality of blades is a multiple of three.

5. A road cleaning vehicle as claimed in claim 1 wherein the first angle about the center of rotation of the impeller between the inner end and corner is 132.5°.

6. A road cleaning vehicle as claimed in claim 1 wherein a throat size of the outlet passageway increases towards an exit of the outlet passageway.

7. A road cleaning vehicle as claimed in claim 1 wherein the wall is positioned such that a substantially similar amount of air is directed through each of the first and second passageways when the impeller is rotating.

8. A road cleaning vehicle as claimed in claim 1 wherein the inner end is positioned midway between an outer periphery of the impeller and casing in the volute portion.

9. A road cleaning vehicle as claimed in claim 1 wherein an exit of the outlet passageway is connected to a rear outlet arrangement, the rear outlet arrangement comprising an internal rear duct enclosed by a cover leading to an air exit from the centrifugal fan assembly.

10. A road cleaning vehicle as claimed in claim 9 wherein the internal rear duct is split into first and second passageways by a wall.

11. A road cleaning vehicle as claimed in claim 9 wherein a throat size of the internal rear duct increases towards the air exit.

12. A road cleaning vehicle as claimed in claim 1 wherein the impeller comprises first and second plates mounted around a hub, the plurality of blades being mounted between the first and second plates and spaced around the hub, wherein each blade has a first adjacent blade located on one side thereof and a second adjacent blade located on an opposing side thereof, and the spacing between each blade and the first adjacent blade is different to the spacing between each blade and the second adjacent blade.

13. A road cleaning vehicle as claimed in claim 12 wherein the plurality of blades are formed of one or more set(s) selected from the group consisting of a leading blade, a primary blade and a lagging blade, wherein:

the leading blade is separated from the primary blade by a first angle;

the lagging blade being separated from the leading blade by a second angle;

the primary blade being separated from an adjacent leading blade by a third angle; and the third blade angle is greater than the first blade angle and the second blade angle is greater than the third blade angle.

14. A road cleaning vehicle as claimed in claim 13 wherein the first blade angle is X°, the second blade angle is X°+2Y° and the third blade angle is X°+Y°.

15. A road cleaning vehicle as claimed in claim 12 wherein the blades are rearwardly curved.

16. A road cleaning vehicle as claimed in claim 12 wherein an offset angle between the inner end and corner is calculated using an equation:

$$\text{Offset Angle} = N_{set} \times \left(\frac{2\pi}{n}\right) + \frac{(N_{set} \times Y)}{p} + Y$$

in which $N_{set}$ is a number of sets of blades, n is a total number of blades, p is a number of restrictions and Y is a difference between the first and third angles.

* * * * *